US005747141A

United States Patent [19]

Claytor

[11] Patent Number: 5,747,141

[45] Date of Patent: May 5, 1998

[54] PAPERBOARD PACKAGING WITH AN IMPROVED SIZING LAYER INCLUDING A STYRENE MALEIC ANHYDRIDE BINDER FOR REDUCING EDGEWICKING

[75] Inventor: Robinson Camden Perkins Claytor, Covington, Va.

[73] Assignee: Westvaco Copration, New York, N.Y.

[21] Appl. No.: 503,175

[22] Filed: Jul. 17, 1995

[51] Int. Cl.[6] ..... B32B 5/24; B32B 9/06

[52] U.S. Cl. ..... 428/143; 428/452; 428/454; 428/511; 428/537.5; 428/331; 428/332; 428/149; 162/135; 162/136; 162/137; 162/168.1

[58] Field of Search ..... 428/452, 454, 428/511, 537.5, 331, 332, 143, 149; 162/137, 135, 136, 168.1

[56] References Cited

U.S. PATENT DOCUMENTS

| | | | |
|---|---|---|---|
| 2,576,914 | 12/1951 | Barrett | 428/454 |
| 2,577,624 | 12/1951 | Niles | 428/452 |
| 3,159,922 | 12/1964 | Dunn | 33/628 |
| 3,428,485 | 2/1969 | Bonzagni | 428/452 |
| 3,901,998 | 8/1975 | Wasley et al. | 428/507 |
| 4,147,585 | 4/1979 | Topfl | 161/135 |
| 4,154,899 | 5/1979 | Hershey et al. | 428/537 |
| 4,331,718 | 5/1982 | Gleichechagen et al. | 427/391 |
| 4,505,962 | 3/1985 | Lu | 428/35 |
| 4,543,280 | 9/1985 | Fujita et al. | 428/35 |
| 4,579,774 | 4/1986 | Kuwazuru et al. | 428/290 |
| 4,581,147 | 4/1986 | Branch, III | 252/8.5 C |
| 4,711,671 | 12/1987 | Mazzarella et al. | 106/243 |
| 4,913,775 | 4/1990 | Langley et al. | 162/164.3 |
| 4,987,170 | 1/1991 | Ishida et al. | 524/267 |
| 5,034,449 | 7/1991 | Mallikarjun | 524/504 |
| 5,082,717 | 1/1992 | Yaguchi et al. | 428/207 |
| 5,156,920 | 10/1992 | Aycock et al. | 428/517 |
| 5,171,640 | 12/1992 | Wirth | 428/515 |
| 5,209,986 | 5/1993 | Fischer et al. | 428/520 |
| 5,219,628 | 6/1993 | Hathaway et al. | 428/36.9 |
| 5,248,562 | 9/1993 | Palermo et al. | 428/527 |
| 5,362,573 | 11/1994 | Pandian et al. | 428/511 |

*Primary Examiner*—William Watkins

*Attorney, Agent, or Firm*—J. R. McDaniel; R. L. Schmalz

[57] ABSTRACT

This invention relates to substrates for paperboard packing with an improved sizing layer including a styrene maleic anhydride binder for reducing edgewicking. Such structures of this type, generally, reduce the edgewick in the paperboard package such that catastrophic failure of the paperboard package is substantially reduced.

5 Claims, 1 Drawing Sheet

PAPERBOARD PACKAGING WITH AN IMPROVED SIZING LAYER INCLUDING A STYRENE MALEIC ANHYDRIDE BINDER FOR REDUCING EDGEWICKING

BACKGROUND OF THE INVENTION

1. Field of the Invention

This invention relates to substrate for paperboard packaging having a press-applied barrier coating. Such structures of this type, generally, reduce the edgewick in the paperboard package such that catastrophic failure of the paperboard package is substantially reduced.

2. Description of the Related Art

It is known, in paperboard packaging, to produce a paperboard carton with a press-applied barrier coating on the nonclay-coated side. Due to the lack of hold-out, severe pin-holding may be observed. On a clay-coated side, a nearly pin-hole free, press- applied film may be achieved. However, during folding and scoring operations, pin holes develop in the press-applied barrier film at corners and seams and may result in the food product attacking the paperboard layer resulting in catastrophic failure. Also, if a clay-coated surface is required beneath the press-applied film, this may require exterior printing on a nonclay-coated side if C1S (coated one side) board is used. This may dramatically reduce the print quality of the package. Consequently, a more advantageous substrate, then, would be presented if such edgewicking could be substantially reduced.

It is also known, in paper coating systems, to make use of styrene maleic anhydride as a coating binder for mineral coated paper. Exemplary of such prior art is U.S. Pat. No. 2,577,624 ('624) to George E. Niles, entitled "Mineral-Coated Paper and Process of Producing Same". While the styrene maleic anhydride is used as a coating binder for the mineral coated paper, its presence in the coating does not contribute to any edgewick resistance of the substrate. Thus, it would not adequately prevent edgewicking. Consequently, a still further advantageous substrate, then, would be presented if a suitable sizing compound were employed that prevented edgewicking.

It is apparent from the above that there exists a need in the art for a substrate for paperboard packaging which is capable of reduced edgewicking and Cobb measurements, but which at the same time is able to have a press-applied barrier placed on one side of the paperboard. It is a purpose of this invention to fulfill this and other needs in the art in a manner more apparent to the skilled artisan once given the following disclosure.

SUMMARY OF THE INVENTION

Generally speaking, the invention fulfills these needs by providing a substrate for paperboard packaging, comprising a first layer of particulate minerals, a first layer of a sizing material including a copolymer binder for substantially preventing edgewicking located interior to the first layer of particulate minerals, a paperboard layer located interior to the first layer of the sizing material, a second layer of a sizing material located interior to the paperboard layer, and a second layer of particulate minerals located interior to the second layer of the sizing material.

In certain preferred embodiments, the particulate minerals are clay. Also, the copolymer binder is styrene maleic anhydride.

In another further preferred embodiment, essentially all of the edgewicking is reduced within the substrate such that the paperboard package should not catastrophically fail.

The preferred substrate, according to this invention, offers the following advantages: eases of assembly; excellent stability; excellent durability; good economy and excellent edgewicking characteristics. In fact, in many of the preferred embodiments, these factors of ease of assembly, stability, durability and edgewicking are optimized to the extent that is considerably higher than heretofore achieved in prior, known substrates.

The above and other features of the present invention, which will become more apparent as the description proceeds, are best understood by considering the following detailed description in conjunction with the accompany drawings, wherein like characters represent like parts throughout the several views and in which:

DETAILED DESCRIPTION OF THE INVENTION

Figure 1:
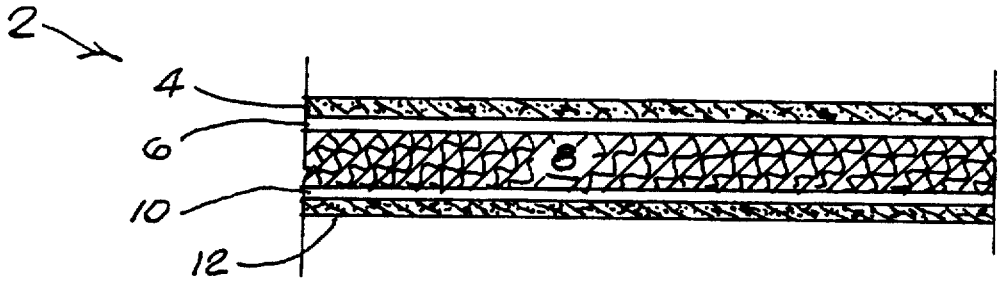
FIG. 1 is a vertical, cross-sectional view of the coated two-side base stock, according to the present invention.

With reference first ti FIG. 1, there is illustrated substrate 2 for paperboard packaging. Substrate 2 includes, in part, conventional exterior particulate coating 4, sizing layer 6, paperboard substrate 8, surface sizing layer 10, and conventional particulate coating 12.

In particular, particulate coatings 4 and 12, preferably, are constructed of clay or calcium carbonate. Surface sizing layers 6 and 10, preferably, employ the use of styrene maleic anhydride binder (SMA) which is applied at a rate of around 4% concentration, by weight. Substrate 8 is, typically, constructed from a 0.018 inch thick sheet of solid bleached sulfate (SBS), solid unbleached sulfate (SUS) or clay coated newsback (CCNB). The term "paperboard" describes paper within the thickness range of 0.007 to 0.028 inches. The invention is relevant to the full scope of such a range, as applied to packaging and beyond.

The present invention incorporates a combination of various concepts in manufacturing ovenable paperboard substrates. These concepts are the use of coated two-sided board with a specific sizing method that is measured using a nontraditional method of measuring Cobb (Z-direction water penetration). Coated two-side board, according to the present invention, is manufactured without using the conventional high internal wet-end alum/size recipe for conventional C1S ovenable paperboard, but the more typical recipe used foe standard folding carton solid bleached sulfate (SBS) in order to enhance runnability. Additional sizing is achieved using a size press application of a surface size such as styrene maleic anhydride. This allows the Cobb value to be reliably obtained below 120 without the difficulties in manufacturing a highly sized, coated two-side board.

Figure 2:
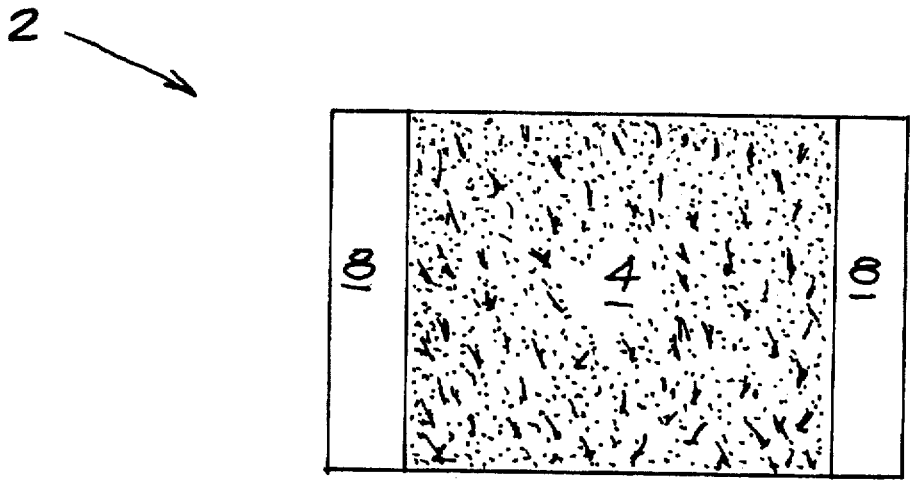
FIG. 2 is a top plan view of the coated two-side base stock, according to the present invention.

Since the board of the present invention is clay-coated on both sides, Cobb cannot be measured using the standard apparatus that measures four square inches. A smaller Cobb device, which measures one square inch, is utilized and the measurement is taken at the edge strip where the base stock 2 is not clay coated (FIG. 2) This is a less desirable measurement than the TAPPI standard method, but surface size has been demonstrated to more reliably size to a particular Cobb than internal sizing, especially when coated two-side broke is used in the furnish. The size press application of the surface size (layer 6) also penetrates the board sufficiently such that edgewick is reduced sufficiently.

The following Example is provided to further illustrate the present invention and is not to be construed as limiting the invention in any manner.

| | |
|---|---|
| Coat Weights of Particulate Mineral Coating: | 10 lbs/ream on each side |
| Coat Weights of Sizing Material: | approximately 2 lbs/reams |
| Concentration by weight of SMA Copolymer in Size Press Final Solids: | 4% |
| Board Caliper: | .018 |
| TAPPI Cobb (Triton) 45 seconds: | 120 maximum |

This method of manufacturing yields a substrate that can be converted into cartons, trays and lids for holding oily and aqueous food products. Pin holing was not encountered and minimal effect was observed in the runnability of the paper machine. Finally, proper selection of the press-applied barrier coating may yield a carton that is suitable for cooking in the microwave or conventional oven.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A composite structure for paperboard packaging for reducing edgewicking, wherein said structure is consisting essentially of:

a first layer of particulate minerals;

a first layer of a sizing material including a styrene maleic anhydride binder for substantially reducing edgewicking located interior to said first layer of particulate minerals, wherein said binder has a concentration by weight of approximately 4%;

a paperboard layer located interior to said first layer of said sizing material wherein said paperboard layer is further comprised of a furnish substantially of broke from coated two-side paperboard;

a second layer of said sizing material including said binder located interior to said paperboard layer; and a second layer of particulate minerals located interior to said second layer of said sizing material.

2. The structure, as in claim 1, wherein said first layer of particulate minerals is further comprised of:

clay.

3. The structure, as in claim 1, wherein said first layer of particulate minerals is further comprised of:

calcium carbonate.

4. The structure, as in claim 1, wherein said second layer of particulate minerals is further comprised of:

clay.

5. The structure, as in claim 1, wherein said second layer of particulate minerals is further comprised of:

calcium carbonate.

* * * * *

UNITED STATES PATENT AND TRADEMARK OFFICE

CERTIFICATE OF CORRECTION

PATENT NO. : 5,747,141

DATED : May 5, 1998

INVENTOR(S) : Robinson Camden Perkins Claytor

It is certified that error appears in the above-indentified patent and that said Letters Patent is hereby corrected as shown below:

Column 2, line 26, delete "ti", insert --to--.
line 51, delete "foe", insert --for--.
line 63, after "(FIG.2)", insert --.--.

Signed and Sealed this

Seventh Day of July, 1998

Bruce Lehman

*Attest:*

BRUCE LEHMAN

*Attesting Officer*

*Commissioner of Patents and Trademarks*